US005676057A

United States Patent [19]

Hummel et al.

[11] Patent Number: 5,676,057

[45] Date of Patent: Oct. 14, 1997

[54] DEVICE FOR MOUNTING A ROLLER IN A PRINTING MACHINE

[75] Inventors: Peter Hummel, Offenbach am Main; Robert Ortner, Alzenau, both of Germany

[73] Assignee: MAN Roland Druckmaschinen AG, Germany

[21] Appl. No.: 643,039

[22] Filed: May 2, 1996

[30] Foreign Application Priority Data

May 3, 1995 [DE] Germany ..... 195 16 131.9

[51] Int. Cl.[6] ..... B41F 31/00

[52] U.S. Cl. ..... 101/349; 101/145; 101/148; 101/247; 101/352

[58] Field of Search ..... 101/218, 139, 101/140, 144, 145, 148, 247, 349, 351, 352, 184, 185, 192, 209; 384/255

[56] References Cited

U.S. PATENT DOCUMENTS

| | | | |
|---|---|---|---|
| 2,986,086 | 5/1961 | Siebke | 101/218 |
| 3,691,956 | 9/1972 | James et al. | 101/352 |
| 4,130,057 | 12/1978 | List et al. | 101/352 |
| 4,385,559 | 5/1983 | Jarach | 101/352 |
| 4,395,947 | 8/1983 | Despot | 101/352 |
| 4,458,591 | 7/1984 | Guaraldi | 101/352 |
| 4,481,882 | 11/1984 | Rudolph | 101/352 |
| 5,265,529 | 11/1993 | Tafel | 101/247 |
| 5,301,609 | 4/1994 | Guaraldi et al. | 101/247 |
| 5,488,902 | 2/1996 | Dorenkamp | 101/352 |

FOREIGN PATENT DOCUMENTS

| | | |
|---|---|---|
| AS 1 227 916 | 4/1962 | Germany . |
| 91 10 345.2 U1 | 11/1991 | Germany . |

*Primary Examiner*—Eugene H. Eickholt
*Attorney, Agent, or Firm*—Leydig, Voit & Mayer, Ltd.

[57] ABSTRACT

A device for mounting an applicator roller of a dampening unit in a printing machine is disclosed. The device is adapted for rotatably receiving a roller journal of the applicator roller and for fixing that journal relative to the frame part of the printing machine to provide jolt-free operation of the applicator roller. The device is also adapted to provide linear movement of the applicator roller relative to its adjacent plate and dipping cylinders. The device preferably includes adjusting eccentrics mounted one in the other. The adjusting eccentrics are independently adjustable. The eccentricities of the adjusting eccentrics are arranged such that the applicator roller can be thrown-on, thrown-off and set approximately radially both to the plate cylinder and to the dipping roller. As a result of the independent adjustability of the eccentrics, the applicator roller can be optionally thrown-on to the plate cylinder without contacting the dipping roller or vice versa.

19 Claims, 7 Drawing Sheets

DEVICE FOR MOUNTING A ROLLER IN A PRINTING MACHINE

FIELD OF THE INVENTION

The invention relates generally to printing machines and more particularly to a device for mounting a roller in a printing machine such as a sheet-fed offset printing press.

BACKGROUND OF THE INVENTION

Offset printing machines often include dampening units for feeding dampening medium onto a plate cylinder carrying a printing forme or plate. These dampening units typically include one or more applicator rollers and associated adjusting means for moving the applicator roller into and out of contact with adjacent cooperating rollers such as the plate cylinder. This movement of the applicator roller is often spoken of as a "throwing-on" or "throwing-off" of the applicator roller relative to another cooperating roller.

The adjusting means employed in these prior art designs have certain disadvantages. For example, these prior art adjusting means often cause irregularities in the transference of dampening medium during the rotation of the plate cylinder. Specifically, the plate cylinder includes an opening disposed on its surface and parallel to its longitudinal axis for receiving the ends of the printing plate and for clamping that plate firmly on the plate cylinder. This opening is commonly called the cylinder channel. When an applicator roller runs over the cylinder channel of the plate cylinder, it can be jolted in a manner that produces irregularities in the transference of the dampening medium conveyed by the applicator roller.

Conventional roller mountings are particularly susceptible to this disadvantage. Specifically, in conventional roller mountings, the roller is mounted on each of its ends by a roller journal in a pivoting arm which, by means of a cam mechanism or other throw-off device, can be moved towards or away from the adjacent rollers and the plate cylinder. The cam mechanism acts counter to a spring force which biases the applicator roller towards the plate cylinder. Thus, when the applicator roller runs over the cylinder channel, the spring force will cause a slight radial movement of the applicator roller thereby resulting in the undesirable irregularities noted above. Although attempts to limit these radial movements by means of fixed stops have been made, they have not satisfactorily prevented these irregular movements from occurring.

OBJECTS OF THE INVENTION

It is, therefore, a general object of the invention to provide an improved device for mounting a roller in a printing machine. More specifically, it is an object of the invention to provide an improved device for mounting an applicator roller in a printing machine which prevents the applicator roller from being jolted by contact with the cylinder channel thereby preventing undesirable irregularities from occurring in the transference of the medium carried by the applicator roller. It is a related object to provide such a device wherein the device is fixed to the frame of the printing machine to ensure jolt-free operation even when the applicator roller runs over blemishes, such as the cylinder channel, in the plate cylinder.

It is a further object of the invention to provide a device for mounting an applicator roller in a printing machine which allows an exact setting of the applicator roller both relative to the plate cylinder and relative to the adjacent rollers. It is a further object to provide such a device wherein the applicator roller can be thrown-on and thrown-off the plate cylinder and a second adjacent cylinder independently of one another.

SUMMARY OF THE INVENTION

The present invention accomplishes these objectives and overcomes the drawbacks of the prior art by providing a device for rotatably mounting a movable roller having first and second opposed journals disposed at its opposite ends in a printing machine. The device comprises: a mounting fixed to the frame of the printing machine; and, a bearing mounted within the mounting for rotatably receiving the first opposed journal of the movable roller and for linearly moving the movable roller into and out of contact with first and second adjacent rollers in the printing machine. The bearing is fixed relative to the frame of the printing machine to prevent the movable roller from being jolted by blemishes in the first and second adjacent rollers during operation of the printing machine.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
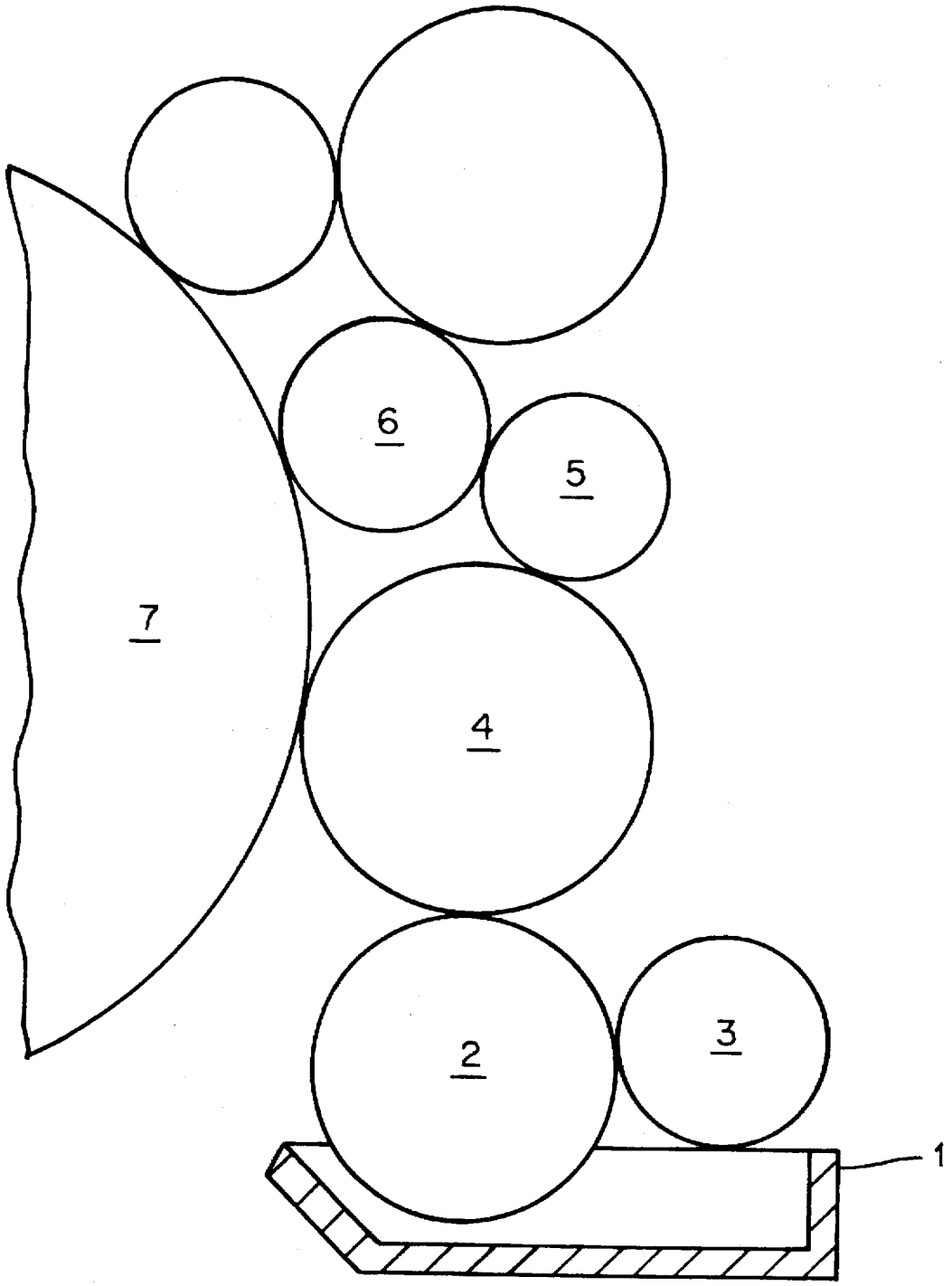
FIG. 1 is a schematic illustration of a representative dampening unit.

A dampening unit in an offset printing machine is represented generally in FIG. 1. The dampening unit consists of a water fountain 1, a dipping roller 2, a metering roller 3 thrown-on the dipping roller 2, and an applicator roller 4 which is arranged between the dipping roller 2 and a plate cylinder 7. The applicator roller 4 is connected to a first inking roller 6 by means of a bridge roller 5. The inking roller 6 and the applicator roller 4 are thrown-on the plate cylinder 7. The plate cylinder 7 has on its circumference a cylinder channel which serves for clamping a printing plate to the surface of the plate cylinder 7 in a manner known in the art. During rotation of the plate cylinder 7, this cylinder channel will come into contact with the applicator roller 4 and the inking roller 6.

Figure 2:
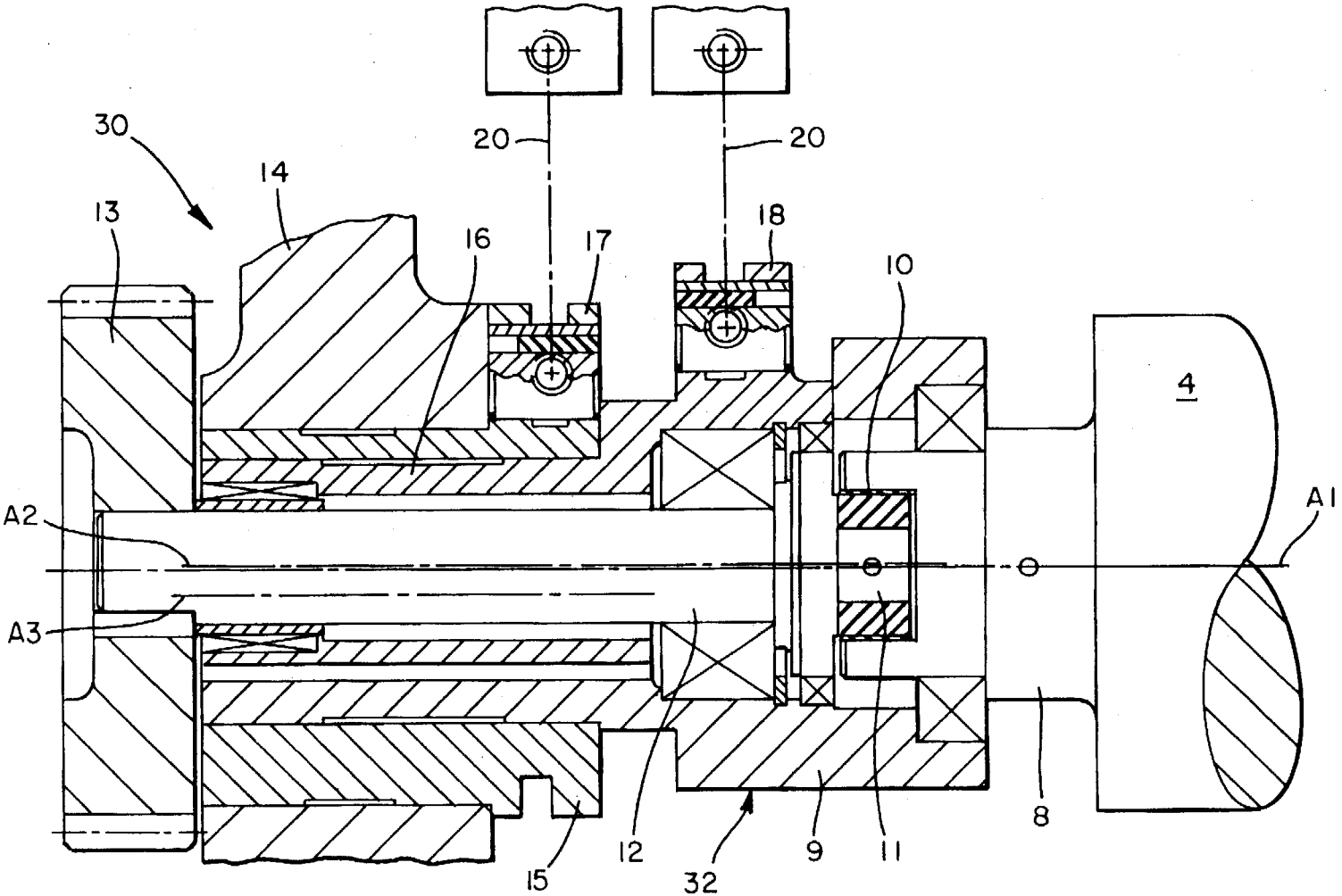
FIG. 2 is a cross-sectional view of a device for mounting a roller in a printing machine constructed in accordance with the teachings of the instant invention.

In accordance with an important aspect of the invention, the applicator roller is rotatably mounted in devices which are fixed relative to the frame of the printing machine to prevent the applicator roller from being jolted by contact with the cylinder channel. In the illustrated embodiment, the applicator roller 4 includes a short roller journal 8 at each of its opposite ends. Each of these journals 8 is received within a device 30 constructed in accordance with the teachings of the invention (FIG. 2). Each of these devices 30 includes a bearing 32 mounted within a mounting 14 which is, in turn, fixed to the frame of the printing machine. As explained in detail below, since these devices 30 are fixed relative to the frame of the printing machine, the applicator roller 4 cannot be jolted by encountering irregularities (such as cylinder channels) in the surface of adjacent cylinders.

For the purpose of coupling the roller 4 to the bearing 32 of the device 30, the bearing 32 is provided with a bearing shell 9. The bearing shell 9 is constructed as a so-called roller lock, in which the roller journal 8 can be fixed relative to the bearing shell 9 such that the applicator roller 4 and the bearing shell 9 move as a single unit.

In order to couple the applicator roller 4 to the drive train of the printing machine, the bearing 32 is further provided with a driving gearwheel 13 and a drive shaft 12. As shown in FIG. 2, the drive shaft 12 is disposed within the bearing shell 9 and extends from the gearwheel 13 to the roller journal 8. To couple the roller journal 8 to the drive shaft 12, the end face of the roller journal 8 is provided with a recess 10. When the applicator roller 4 is inserted into the bearing shell 9, the recess 10 receives a disc-shaped drive element 11 which is, in turn, coupled to the drive shaft 12. Thus, when the applicator roller 4 is inserted into the bearing shell 9, it is connected coaxially and immovably to the drive shaft 12. As a result, the drive shaft 12, the roller journal 8, and the applicator roller 4 are all rotatable driven by the interaction of the drive train of the printing machine and the gearwheel 13.

In accordance with another aspect of the invention, the bearing is provided with adjusting means for both rotatable mounting the drive shaft and the roller journal within the mounting fixed to the frame of the printing machine and for selectively throwing the applicator roller on and off the adjacent cylinders in the printing machine. In the illustrated embodiment, the adjusting means comprises first and second adjusting eccentrics 15, 16. The first adjusting eccentric 15 is mounted within the frame part 14 and the second adjusting eccentric 16 is mounted within the first adjusting eccentric 15. The drive shaft 12 can freely rotate within the second adjusting eccentric 16. As explained in detail below, since the first and second adjusting eccentrics 15, 16 are not mounted coaxially with either the drive shaft 12, the roller journal 8 or the applicator roller 4, rotating the eccentrics 15, 16 will cause the applicator roller 4 to move linearly relative to the adjacent cylinders 2, 7 in the printing machine.

Figure 3:
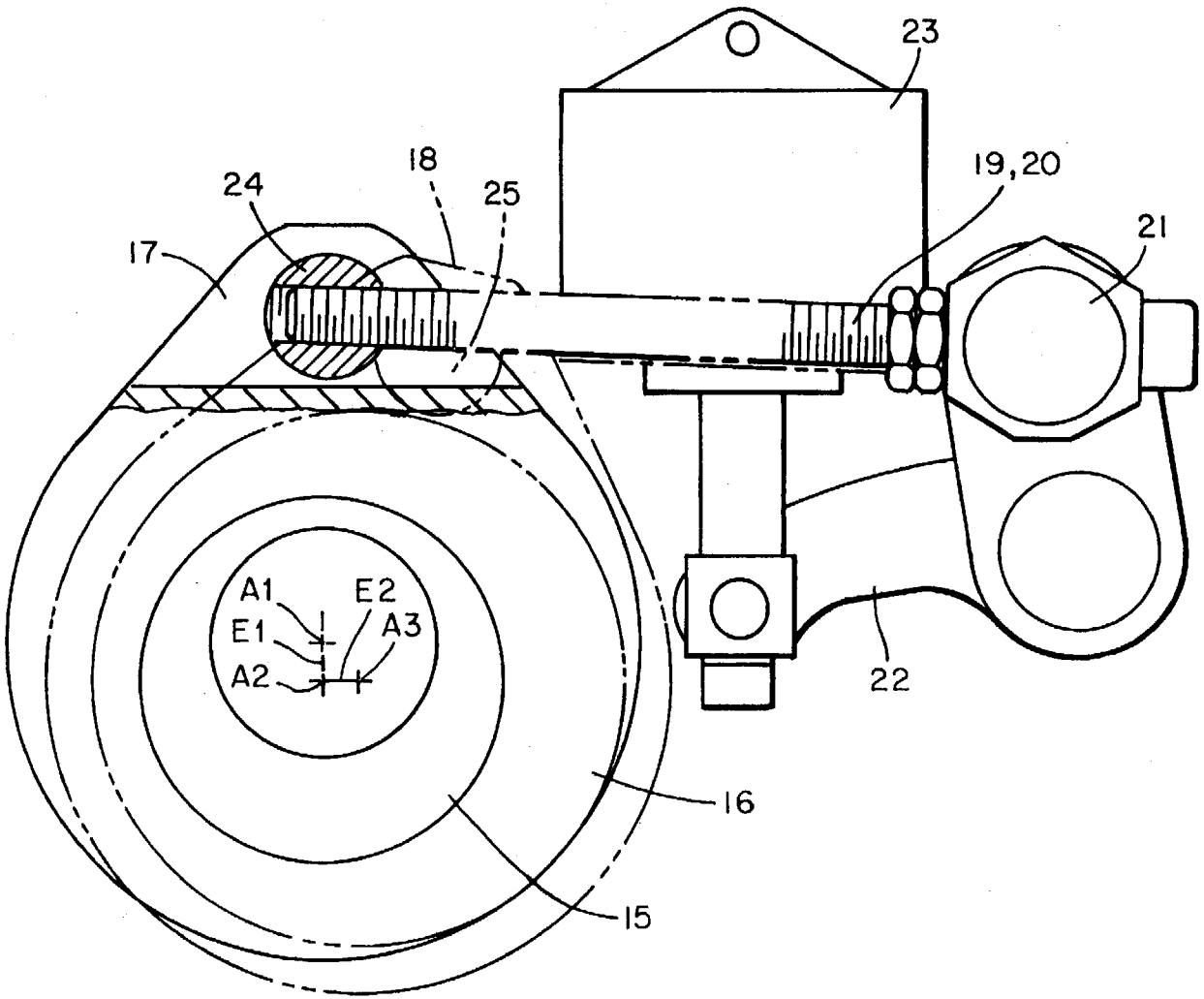
FIG. 3 is a partial side view of the device of FIG. 2.

For the purpose of effecting this linear movement, the adjusting eccentrics 15, 16 are provided with adjusting levers 17, 18 coupled to adjusting rods 19, 20, respectively. The adjusting eccentric 15 is, thus, held and rotated by the adjusting rod 19 via the adjusting lever 17. The adjusting eccentric 16, on the other hand, is held and rotated by the adjusting rod 20 acting on the adjusting lever 18. More specifically, the adjusting rods 19, 20 are coupled to a drive lever 22 via an adjustable rotary connection 21 (FIG. 3). A pneumatic cylinder 23 coupled to the drive lever 22 loads the rods 19, 20 and effects linear movements of the applicator roller 4 through the rotary connection 21.

Figure 4:
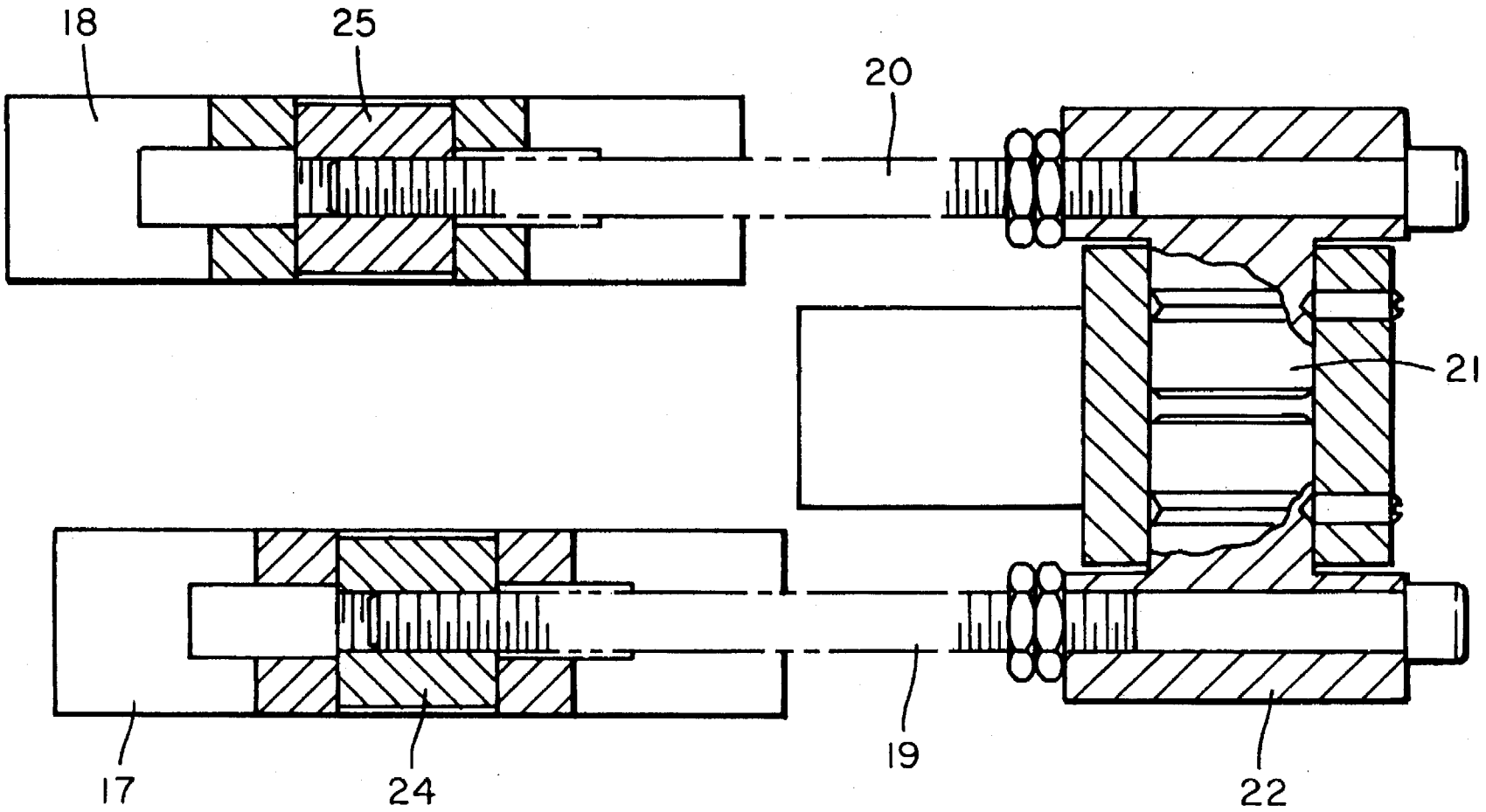
FIG. 4 is a top view of the structures illustrate in FIG. 3.

In order to provide for compensating movements of the adjusting rods 19, 20 relative to the drive lever 22 and relative to the adjusting levers 17, 18 during movements of the drive lever 22, the adjusting rods 19, 20 are screwed into sliding pieces 24, 25 which are coupled to the adjusting levers 17, 18 (FIG. 4). The opposite ends of the rods 19, 20 are rotatable secured within the drive lever 22 by locknuts. Thus, the relative lengths of the rods 19, 20 can be adjusted by screwing (or unscrewing) the adjusting rods 19, 20 into (or out of) the sliding pieces 24, 25 to change the relative positions of the first and second eccentrics 15, 16.

The arrangement of the adjusting eccentrics 15, 16 and the manner in which they effect the linear movement of the applicator roller 4 will now be explained in connection with FIG. 3. In particular, the relationship between the eccentricities, (or the axial positions of the adjusting eccentrics 15, 16), in relation to the common longitudinal axis of the drive shaft 12 and the applicator roller 4 will be discussed. It should be noted that, in the illustrated embodiment, an axis A1 is provided for the applicator roller 4; an axis A2 is provided for the adjusting eccentric 15; and, an axis A3 is provided for the adjusting eccentric 16. The axes A1, A2 and A3 are preferably positioned in a specific relation to one another, the design and purpose of which are explained in further detail below.

In order to ensure that the rotational movements of the eccentrics 15, 16 respectively move the applicator roller 4 substantially radially towards the plate cylinder and the dipping cylinder during the throw-on and throw-off procedures, the axes A1, A2, and A3 are located in predetermined locations. More specifically, the axes A1, A2 and A3 are not coaxial, but are instead positioned a distance from one another. The axes A1, A2 form an eccentricity E1 of the applicator roller 4 relative to the plate cylinder 7. The axes A2 and A3 form an eccentricity E2 of the applicator roller 4 relative to the dipping roller 2; the eccentricity E2 being the distance between the axes of rotation of the adjusting eccentrics 15, 16.

The orientation of, and the distances between, these axes are selected such that the adjustment possibilities produce as ideal radial movements as possible. Thus, the axis A1 of the applicator roller 4 is arranged relative to the axis A2 of the adjusting eccentric 15 such that the eccentricity E1 corresponding to the distance between those two axes is approximately at right angles to a hypothetical line drawn between the axis A1 of the applicator roller 4 and the axis of the plate cylinder 7. Similarly, the axis A3 of the adjusting eccentric 16 is offset relative to the axis A2 of the adjusting eccentric 15 by the eccentricity E2 at approximately right angles to a hypothetical line drawn between the axis of the applicator roller 4 and the axis of the dipping roller 2. Selecting these positions in this manner ensures both that the eccentricity E1 acts approximately perpendicularly to the adjustment plane defined as a plane tangential to both the applicator roller 4 and the plate cylinder 7 at their point of contact, and that the eccentricity E2 acts approximately perpendicularly to the adjustment plane defined as a plane tangential to both the applicator roller 4 and the dipping roller 2 at their point of contact, during the throw-on, the throw-off, and the setting procedures.

Figure 5:
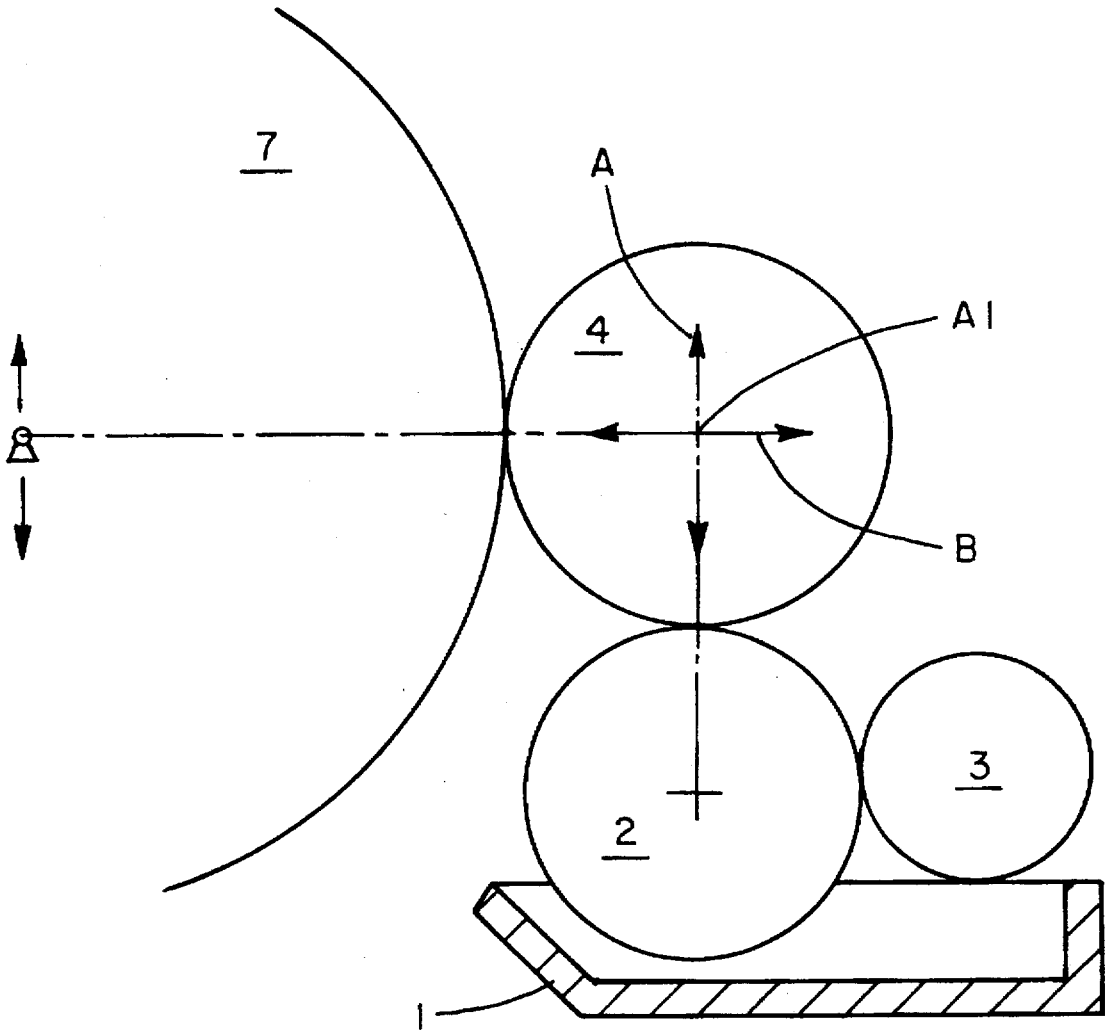
FIG. 5 is a schematic view illustrating the relative positions of the applicator roller, the plate cylinder, and the dipping roller.

This concept is illustrated diagrammatically in FIG. 5. Specifically, the applicator roller 4 can be moved in two throw-on directions A and B. The throw-on direction A is radial to the adjacent surface of the plate cylinder 7 and the throw-on direction B is radial to the adjacent surface of the dipping roller 2. The throw-on direction A corresponds to a hypothetical line drawn between the axis A1 of the applicator roller 4 and the axis of the dipping roller 2. The throw-on direction B corresponds to a hypothetical line drawn between the axis A1 of the applicator roller 4 and the axis of the plate cylinder 7. The throw-on/throw-off movements of the applicator roller 4 preferably take place simultaneously. It would be preferable if the simultaneous throw-on/throw-off movements were directed radially towards the plate cylinder 7 and also radially towards the dipping roller 2. However, due to the simultaneous throw-on/throw-off movement, such simultaneous radial movements are not possible. The superposition of the throw-on/throw-off directions A and B during the simultaneous movements precludes such radial movements from occurring at the same time.

Figure 6:
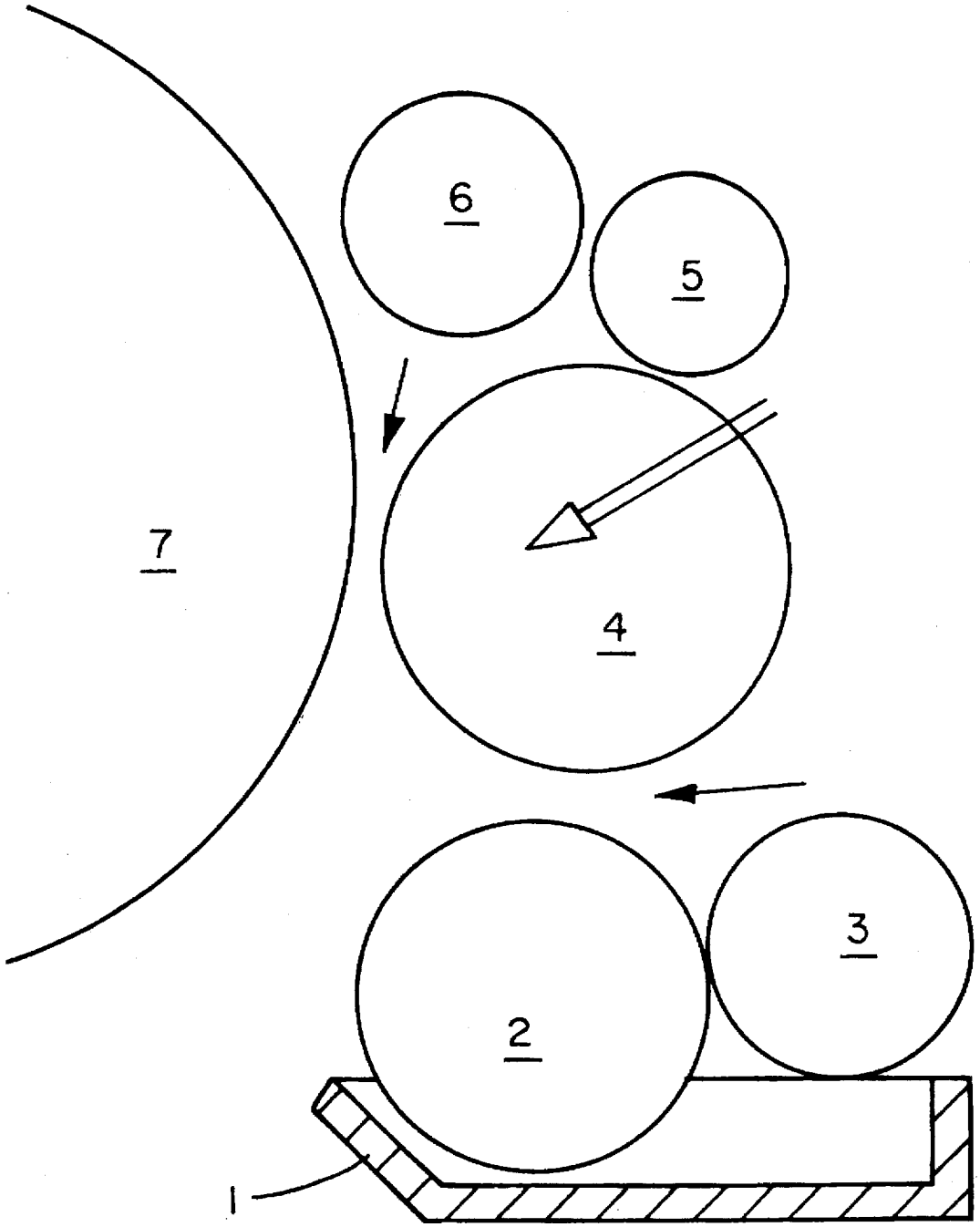
FIG. 6 is a schematic view similar to FIG. 5 but illustrating a first adjusting position of the applicator roller.

In the illustrated embodiment, the two adjusting eccentrics 15, 16 are arranged such that one of the adjusting eccentrics corresponds to the optimum throw-on/throw-off movement relative to the dipping roller 2, and the other adjusting eccentric corresponds to the optimum throw-on/throw-off movement relative to the plate cylinder 7. The joint movement during the throw-on/throw-off movement of the applicator roller 4 results in an optimized average value for the adjusting movement during the adjustment of the applicator roller 4. This joint movement is illustrated diagrammatically in FIG. 6 wherein the throw-off/throw-on movement is indicated in the form of a double arrow. The combined adjusting movement arising from the movements of the two adjusting eccentrics 15, 16 is directed into the gap between the plate cylinder 7 and the dipping roller 2.

The positioning of the applicator roller 4 relative to the plate cylinder 7 and to the dipping roller 2 can be adjusted independently by screwing or unscrewing the adjusting rods 19, 20 from the sliding pieces 24, 25. The basic position of the applicator roller 4 can thereby be fixed at a desired location. Settings can, therefore, be carried out approximately radially relative to both the plate cylinder 7 and the dipping roller 2 by independently adjusting the rods 19, 20. The throw-on/throw-off movement will then be an optimum combination of the throw-on/throw-off movements of the two individual elements, namely the throw-on/throw-off movement radial to the plate cylinder 7 and the throw-on/throw-off movement radial to the dipping roller 2.

Figure 7:
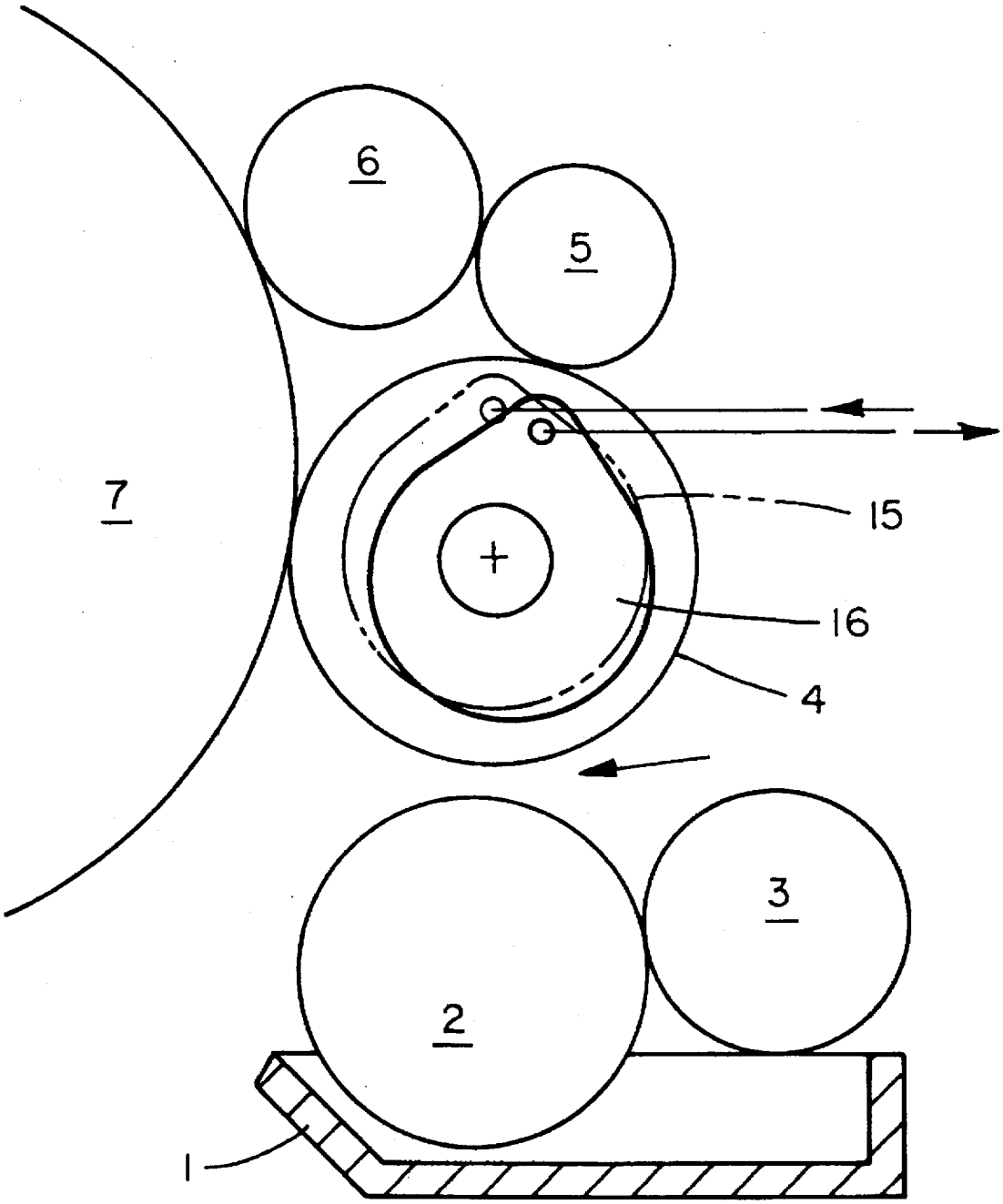
FIG. 7 is a schematic view similar to FIG. 6 but illustrating a second adjusting position of the applicator roller.

Those skilled in the art will readily appreciate that the ability to independently adjust the throw-on/throw-off movements of the application roller 4 in the radial direction of the plate cylinder 7 and in the radial direction of the dipping roller 2, permits the device 30 to be used to couple the application roller 4 to the plate cylinder 7 without contacting the dipping roller 2 and vice versa. For example, in specific instances it may be necessary to throw the applicator roller 4 on to the plate cylinder 7 (and to the inking roller 6 via the bridge roller 5) without contacting the dipping roller 2 (FIG. 7). This setting can be achieved by moving the adjusting rod associated with the adjusting eccentric 16 (which causes the throw-on relative to the dipping roller 2) a suitable amount. In this setting, the applicator roller 4 can be used as an additional ink applicator roller. This is useful, for example, when so-called waterless printing plates are employed in the offset printing machine.

To improve the setting possibilities and to optimize the adjustment effects, the plate cylinder 7 can be constructed to be adjusted by movements tangential to the applicator roller 4. For example, when the effective circumference on the plate cylinder 7 is changed by bringing up the printing plate, a change in distance relative to the adjacent printing-unit cylinder is necessary in order to readjust the so-called print regulation or throw-on pressure. Since the adjusting movements of the plate cylinder 7 are tangential to the applicator roller 4 and since, as explained above, the adjustment planes of the applicator roller 4 are arranged at right angles to one another, these adjustments to the plate cylinder 7 will not require changes in the setting of the applicator roller 4. Further, the print regulation or throw-on pressure of the applicator roller 4 is only minimally influenced by the tangential displacement of the plate cylinder 7. Moreover, there is no need, in the case of relatively long adjustment travels, for any follow-up of the applicator roller 4 which could otherwise be necessary due to the absence of springing of the applicator roller 4.

Those skilled in the art will readily appreciate that, although the inventive device 30 has been illustrated in connection with an applicator roller 4 in a dampening unit, the inventive device 30 is not limited to a particular use or application. For example, the device 30 can be used in all applicator units in printing machines in which an applicator roller is to be thrown-on relative to a forme cylinder and to a roller supplying a liquid. Such applicator units include, for instance, inking units and varnishing units. Furthermore, those skilled in the art will readily appreciate that the instant invention could also be employed in other coating devices that employ rollers.

Finally, although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

What is claimed is:

1. A device for rotatably mounting a movable roller in a printing machine, the movable roller having first and second opposed journals disposed at its opposite ends, the printing machine having a frame and including first and second adjacent rollers, the device comprising:

a mounting fixed to the frame of the printing machine; and, a bearing mounted within the mounting for rotatably receiving the first opposed journal of the movable roller and for selectively moving the movable roller into and out of contact with the first and second adjacent rollers, wherein the bearing is fixed relative to the frame of the printing machine to prevent the movable roller from being jolted by blemishes in the first and second adjacent rollers during operation of the printing machine; and wherein the bearing comprises:

a bearing shell for receiving the first opposed journal of the movable roller;

a drive shaft disposed at least partially within the bearing shell and operatively connected to the first opposed journal for rotating the movable roller; the drive shaft, the first opposed journal and the movable roller having a common axis of rotation;

a first adjusting eccentric disposed at least partially within the bearing shell and having a first axis of rotation, the first axis of rotation being disposed a first distance away from the common axis;

a second adjusting eccentric disposed at least partially within the first adjusting eccentric and having a second axis of rotation, the second axis of rotation being disposed a second distance away from the common axis and being further disposed a third distance away from the first axis of rotation, the drive shaft being disposed at least partially within the second adjusting eccentric;

wherein rotating the first adjusting eccentric about the first axis of rotation moves the drive shaft and the movable roller relative to the first adjacent roller, and rotating the second adjusting eccentric about the second axis of rotation moves the drive shaft and the movable roller relative to the second adjacent roller.

2. A device as defined in claim 1 wherein the first and second adjusting eccentrics operate independently of one another.

3. A device as defined in claim 2 wherein the first adjusting eccentric moves the movable roller in an approximately radial direction relative to the first adjacent roller and the second adjusting eccentric moves the movable roller in an approximately radial direction relative to the second adjacent roller.

4. A device as defined in claim 1 wherein the first and second adjacent rollers and the bearing are disposed such that a hypothetical line drawn between the first axis and the common axis of rotation is substantially perpendicular to a second hypothetical line drawn between the second axis of rotation and the common axis.

5. A device as defined in claim 4 wherein the first adjacent roller is adjustably mounted on the frame and is adjustable in a plane substantially parallel to a tangent to the movable roller.

6. A device as defined in claim 1 wherein the first and second adjusting eccentrics are driven by a single drive system, and wherein the first and second adjusting eccentrics are independently adjustable relative to the drive system.

7. A device as defined in claim 1 wherein the movable roller comprises an applicator roller; the first adjacent cylinder comprises a plate cylinder; and the second adjacent cylinder comprises a dipping roller.

8. A device as defined in claim 1 wherein the first adjusting eccentric has an eccentricity defined as the distance between the first axis of rotation and the common axis, and, when the movable roller is positioned in contact with the first adjacent roller, the eccentricity of the first adjusting eccentric is approximately perpendicular to a hypothetical line drawn between the first axis of rotation and the common axis.

9. A device as defined in claim 8 wherein the second adjusting eccentric has an eccentricity defined as the distance between the second axis of rotation and the common axis, and, when the movable roller is positioned in contact with the second adjacent roller, the eccentricity of the second adjusting eccentric is approximately perpendicular to a hypothetical line drawn between the second axis of rotation and the common axis.

10. A device as defined in claim 1 further comprising:

first and second adjusting rods coupled to the first and second adjusting eccentrics,respectively; and, a drive mechanism for loading the first and second adjusting rods and for selectively moving the first and second eccentrics.

11. A device as defined in claim 10 wherein the first and second adjusting rods are coupled to the drive mechanism via a rotary connection and a drive lever.

12. A device as defined in claim 11 wherein the drive mechanism comprises a pneumatic cylinder.

13. A device as defined in claim 10 wherein the first and second adjusting rods screwingly engage first and second sliding components coupled to the first and second adjusting eccentrics, respectively, and wherein the first and second adjusting rods can be screwingly adjusted relative to the first and second components independently of one another.

14. A device as defined in claim 13 wherein the relative positions of the first and second adjusting eccentrics can be adjusted by screwingly adjusting the position of the first adjusting rod relative to the first sliding component.

15. A device as defined in claim 13 wherein the relative positions of the first and second adjusting eccentrics can be adjusted by screwingly adjusting the position of the second adjusting rod relative to the second sliding component.

16. A device for rotatably mounting a movable roller in a printing machine, the movable roller having first and second opposed journals disposed at its opposite ends, the printing machine having a frame and including first and second adjacent rollers; the device comprising: a mounting fixed to the frame of the printing machine, a bearing mounted within the mounting for rotatably receiving the first opposed journal of the movable roller, said bearing being fixed relative to the frame of the printing machine to prevent the movable roller from being jolted by blemishes in the first and second adjacent rollers during operation of the printing machine, said bearing including first and second adjusting eccentrics for selectively moving the movable roller relative to the first and second adjacent rollers, respectively, said movable roller, first adjacent roller, and second adjacent roller each having an axis of rotation, said first and second adjacent rollers and said bearing being disposed such that a hypothetical line drawn between the axis of rotation of the first adjacent roller and the axis of rotation of the movable roller is substantially perpendicular to a second hypothetical line drawn between the axis of rotation of the second adjacent roller and the axis of rotation of the movable roller, and said first adjacent roller being adjustably mounted on the frame for selective movement in a plane substantially parallel to a tangent to the movable roller.

17. A device for rotatably mounting a movable applicator roller in a printing machine, the applicator roller having first and second opposed journals disposed at its opposite ends, the printing machine having a frame and including a plate cylinder and a dipping roller adjacent said applicator roller, the device comprising:

a mounting fixed to the frame of the printing machine; and, a bearing mounted within the mounting for rotatably receiving the first opposed journal of the applicator roller and for selectively moving the applicator roller into and out of contact with the plate cylinder and dipping roller, wherein the bearing is fixed relative to the frame of the printing machine to prevent the applicator roller from being jolted by blemishes in the plate cylinder and dipping roller during operation of the printing machine.

18. A device for rotatably mounting a movable roller in a printing machine, the movable roller having first and second opposed journals disposed at its opposite ends, the printing machine having a frame and including first and second adjacent rollers, the device comprising: a mounting fixed to the frame of the printing machine, a bearing mounted within the mounting for rotatably receiving the first opposed journal of the movable roller and for selectively moving the movable roller into and out of contact with the first and second adjacent rollers, said bearing being fixed relative to the frame of the printing machine to prevent the movable roller from being jolted by blemishes in the first and second adjacent rollers during operation of the printing machine, said bearing including first and second adjusting eccentrics for selectively moving the movable roller relative to the first and second adjacent rollers, respectively, said first adjusting eccentric receiving the first journal of the movable roller and being rotatably disposed at least partially within the second adjusting eccentric; and said first and second adjusting eccentrics being independently connected to a single drive system via first and second adjustable adjusting rods, respectively.

19. A printing machine comprising: a frame, a first roller, an applicator roller adjacent the first roller for supplying liquid medium to the first roller, a preceding roller adjacent the applicator roller, said applicator roller having first and second opposed journals disposed at its opposite ends, a bearing fixedly supported by said frame for rotatably supporting the first opposed journal of the applicator roller and for preventing the applicator roller from being jolted by blemishes in the first and preceding adjacent rollers, and said bearing having adjustable elements for moving the applicator roller between throw-on and throw-off positions with respect to the first and preceding adjacent rollers.

* * * * *